US005941465A

United States Patent [19]

Richards

[11] Patent Number: 5,941,465

[45] Date of Patent: Aug. 24, 1999

[54] CHARGED DROPLET SPRAY NOZZLE

[76] Inventor: Clyde N. Richards, P.O. Box 216, Peralta, N.Mex. 87042

[21] Appl. No.: 08/385,331

[22] Filed: Feb. 8, 1995

[51] Int. Cl.[6] ..... B05B 5/00

[52] U.S. Cl. ..... 239/690.1

[58] Field of Search ..... 239/421, 525, 239/545, 690, 690.1, 695, 697, 698, 707

[56] References Cited

U.S. PATENT DOCUMENTS

| | | | |
|---|---|---|---|
| 640,887 | 1/1900 | Dolan . | |
| 3,219,276 | 11/1965 | Norris | 239/659 X |
| 4,002,293 | 1/1977 | Simmons | 239/421 |
| 4,106,697 | 8/1978 | Sickles et al. . | |
| 4,266,951 | 5/1981 | Calvert . | |
| 4,509,694 | 4/1985 | Inculet et al. | 239/697 |
| 5,244,149 | 9/1993 | Yuan et al. . | |
| 5,265,802 | 11/1993 | Hobbs et al. | 239/524 |

FOREIGN PATENT DOCUMENTS

| | | | |
|---|---|---|---|
| 121423 | 2/1986 | U.S.S.R. | 239/690.1 |

OTHER PUBLICATIONS pp. 1247–1250, Morse & Feshbach, Methods of Theoretical Physics (McGraw Hill 1953).

Bete Information Sheet on "NF Standard Fan Nozzle" (single page).

*Primary Examiner*—Robert J. Oberleitner
*Attorney, Agent, or Firm*—Robert W. Harris

[57] ABSTRACT

Apparatus for generating large quantities of highly charged droplets, which may be used in gas cleaning machines, as in air pollution control systems. Two opposing, colliding streams of liquid, emitted from opposingly oriented nozzles connected to a pressurized liquid source, generate a spreading disk shaped sheet of liquid, which sheet connected to ground by grounding of the nozzle assembly, and which sheet is emitted between equidistant induction electrodes, maintained at an equal voltage, which induce electric charges in liquid droplets as they leave the edge of the spreading liquid disk, which charges are conveyed to the droplets from the grounded liquid disk and nozzle assembly, through the ground connection of the nozzle assembly.

21 Claims, 5 Drawing Sheets

CHARGED DROPLET SPRAY NOZZLE

BACKGROUND OF THE INVENTION

The present invention concerns devices for producing liquid droplets having large quantities of electric charge, which charged droplets are useful in gas cleaning machines for removal of aerosol particles from gases, by passing the charged droplets through the gas.

There are numerous gas cleaning applications for electrostatic precipitating machines designed for removal of liquid or solid particles of a pollutant found in a flowing gas, such as, for example, removal of particles of smoke found in the gases produced in burning fossil fuels at a power plant, removal of dusts created during grinding and pulverizing processes, and removal of mists created during the operation of various kinds of chemical processes. Although the primary applications of the invention have to do with facilitating gas cleaning through improved operation of such electrostatic precipitating machines, there may as well be other applications of the present invention, including but not limited to applications which cannot presently be anticipated.

The purpose of the invention is the provision of a simple, inexpensive and easily operated device to allow the production of copious quantities of highly charged liquid droplets.

SUMMARY OF THE INVENTION

The invention is an apparatus for producing large quantities of highly charged liquid droplets, for use in apparatus for removing small aerosol particles from a gas by passing the charged liquid droplets through the gas. In the preferred embodiment, liquid is introduced into a grounded nozzle assembly, having two identical, opposing nozzles directing identical streams of the liquid directly against one another, which opposing streams generate a disk of liquid spreading radially outward from the nozzles, spreading to a region in which the liquid disk breaks up into individual droplets, which droplets continue the radial outward motion away from the nozzles. Disk-shaped equally charged induction electrodes, oriented parallel to and on either side of the plane of the liquid disk and spreading droplets, surround the spreading droplets, and induce electrical charges in the droplets, which charges flow to the liquid disk and droplets through the ground connection of the nozzle assembly; the tubing conveying the liquid to the nozzles being electrically conducting tubing, connected to the nozzle assembly ground. Each droplet is equally attracted to each of the equal potential induction electrodes, lying at equal separations on either side of the plane of the liquid disk and spreading droplets, so that the attractions balance, allowing the charged droplet to continue its outward motion in the plane of the liquid disk/droplets, moving beyond the outer edges of the induction electrodes, where the droplets may be used in the gas cleaning apparatus. The droplet charges may be varied by varying the induction electrode voltage, and the droplet size may be varied by varying the liquid orifice sizes and the liquid pressure. Possible alternate forms of the invention include the use of liquid orifices not oriented at 180 degree opposition, so as to produce an elliptically shaped sheet of liquid, to preferentially direct droplets in particular directions; using liquid nozzles of different diameters to produce different sized liquid streams, to as to produce a conical sheet of spreading liquid; combining a single nozzle with a mechanical shearing device, to produce disk or cone shaped sheets of spreading liquid; use of an emulsion for the droplet forming liquid, formed by a liquid containing small gas bubbles, so that the emulsion droplets would have lower density, as compared to the pure liquid, so as to decelerate more rapidly when moving through the gas to be cleaned; use of different pressures in driving the liquid through the two orifices, to produce two streams of different strength, for variation of the resulting liquid sheet flow pattern; and use of liquid conduits which are insulators over the main portion of their length, with the liquid flowing through only a short conducting section so as to acquire charge from the ground connection to the nozzle assembly.

DESCRIPTION OF THE PREFERRED EMBODIMENTS

Figure 1:
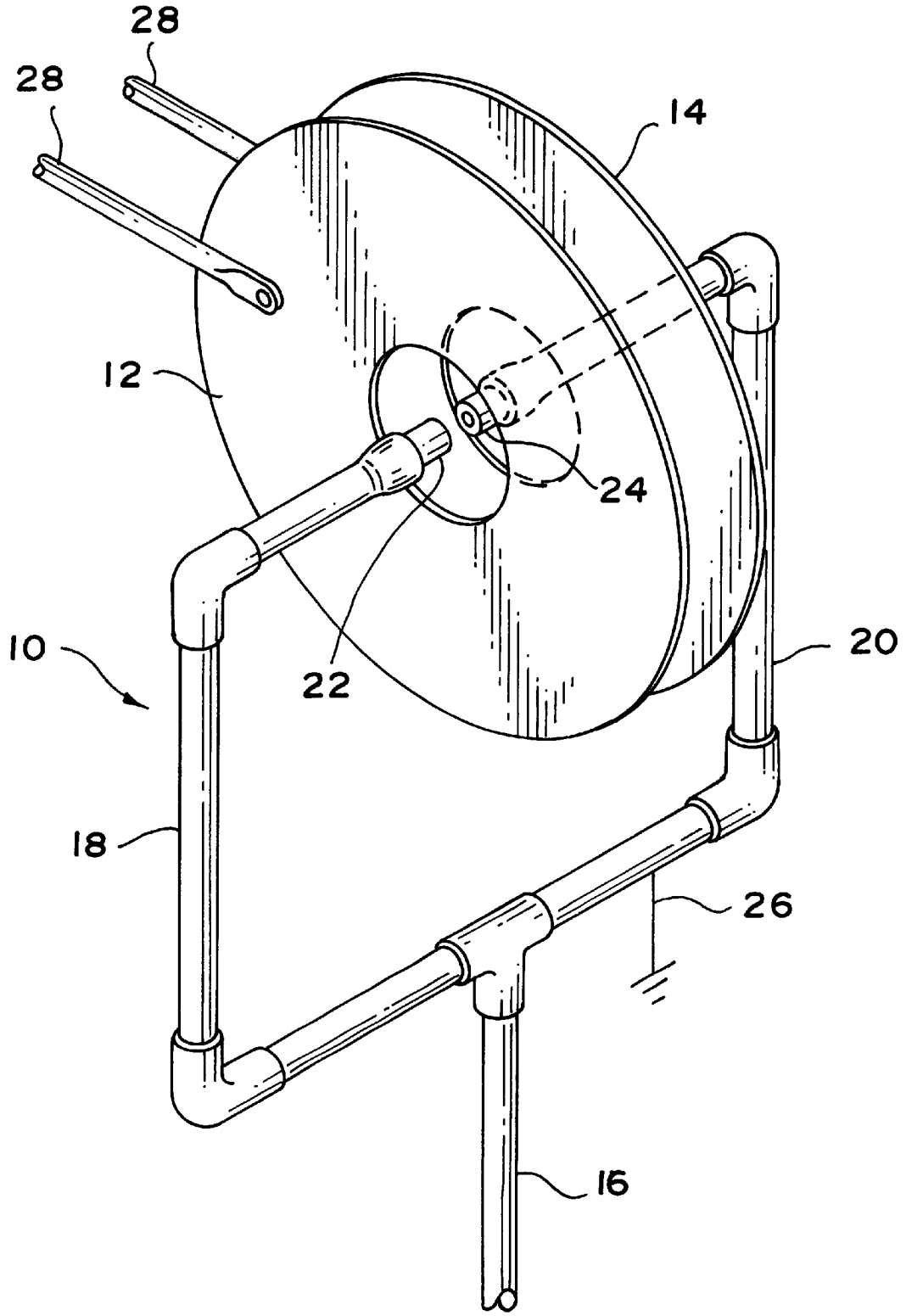
FIG. 1 is a perspective view of the preferred embodiment.

Referring now to the drawings, in which like reference numbers denote like or corresponding elements, the principal components of the apparatus are a nozzle assembly 10, and induction electrodes 12 and 14. The nozzle assembly 10 has an inlet tube 16, which conveys liquid to nozzle assembly 10 from a suitable source of pressurized liquid, which is not part of the present invention. After entering nozzle assembly 10 through inlet tube 16, the flowing liquid is divided into two equal streams by flow tubes 18 and 20, of equal diameter and length, which terminate in opposing, otherwise identical nozzles 22 and 24, which are oriented at 180 degrees opposition, upon a common axis. The entire nozzle assembly 10 is formed of metal piping, and is grounded through a ground wire 26.

Each of the identical induction electrodes 12 and 14 is disk shaped, with a central circular section removed, thus forming an annulus. The central gaps in the induction electrodes 12 and 14 accommodate the sections of the flow tubes 18 and 20 holding the opposing nozzles 22 and 24. The induction electrodes 12 and 14 are coaxial with the axis formed by the opposing nozzles 22 and 24, and are equally spaced about the plane bisecting a line drawn between the nozzles 22 and 24. The induction electrodes 12 and 14, which are electrically insulated from nozzle assembly 10, are each connected to a high voltage source (not shown), by high voltage leads 28.

In order to operate the device to produce charged droplets, the user turns on the pressurized liquid source, conveying pressurized liquid into inlet tube 16, from which the liquid is conveyed through flow tubes 18 and 20 to nozzles 22 and 24. The liquid exits from nozzles 22 and 24 in two oppositely directed, coaxial streams 30 and 32. The streams 30 and 32 collide at point 34, which is the point on their common axis midway between nozzles 22 and 24.

The colliding streams 30 and 32 produce a disk shaped liquid sheet 36, of liquid flowing radially outward from point 34. The plane of liquid sheet 36 is perpendicular to the common axis of streams 30 and 32, and parallel to induction electrodes 12 and 14, and equidistant from induction electrodes 12 and 14.

As the liquid flows radially outward from point 34 in the liquid sheet 36, the circumference of each portion of the liquid, emitted in a given brief time interval, continually increases as the radial distance of said portion from point 34 increases, until the continuous liquid sheet 36 breaks up into individual droplets 38, as indicated at the point 40, which defines the edge of the continuous liquid sheet 36. In fact, of course, the transition from a continuous liquid sheet 36 to individual droplets 38 will not be a sharp one, but there will be a transitional region, which will be narrow for relatively low velocities, but becomes wider as the stream velocities are increased; this transition region is about 1" thick for the preferred embodiment conditions detailed below. The radius of the liquid sheet 36 will be determined by the combination of the fluid intrinsic properties, i.e. surface tension, viscosity and density; and the pressure and the flow rates in streams 30 and 32, which flow rates will be dependent upon the fluid pressure at the nozzles 22 and 24, and the orifice diameters of nozzles 22 and 24. By suitable variation of these parameters, a desired value of the radius of the liquid sheet 36 may be produced. When using ordinary tap water as the liquid, orifice diameter of 0.057" for each of the nozzles 22 and 24, and fluid pressure of about 45 p.s.i., the radius of liquid sheet 36 is roughly 2 to 3 inches (estimated). The radius appears to vary somewhat for a given geometry, apparently as a result of the instability of the liquid sheet breaking up into the droplets 38.

Figure 2:
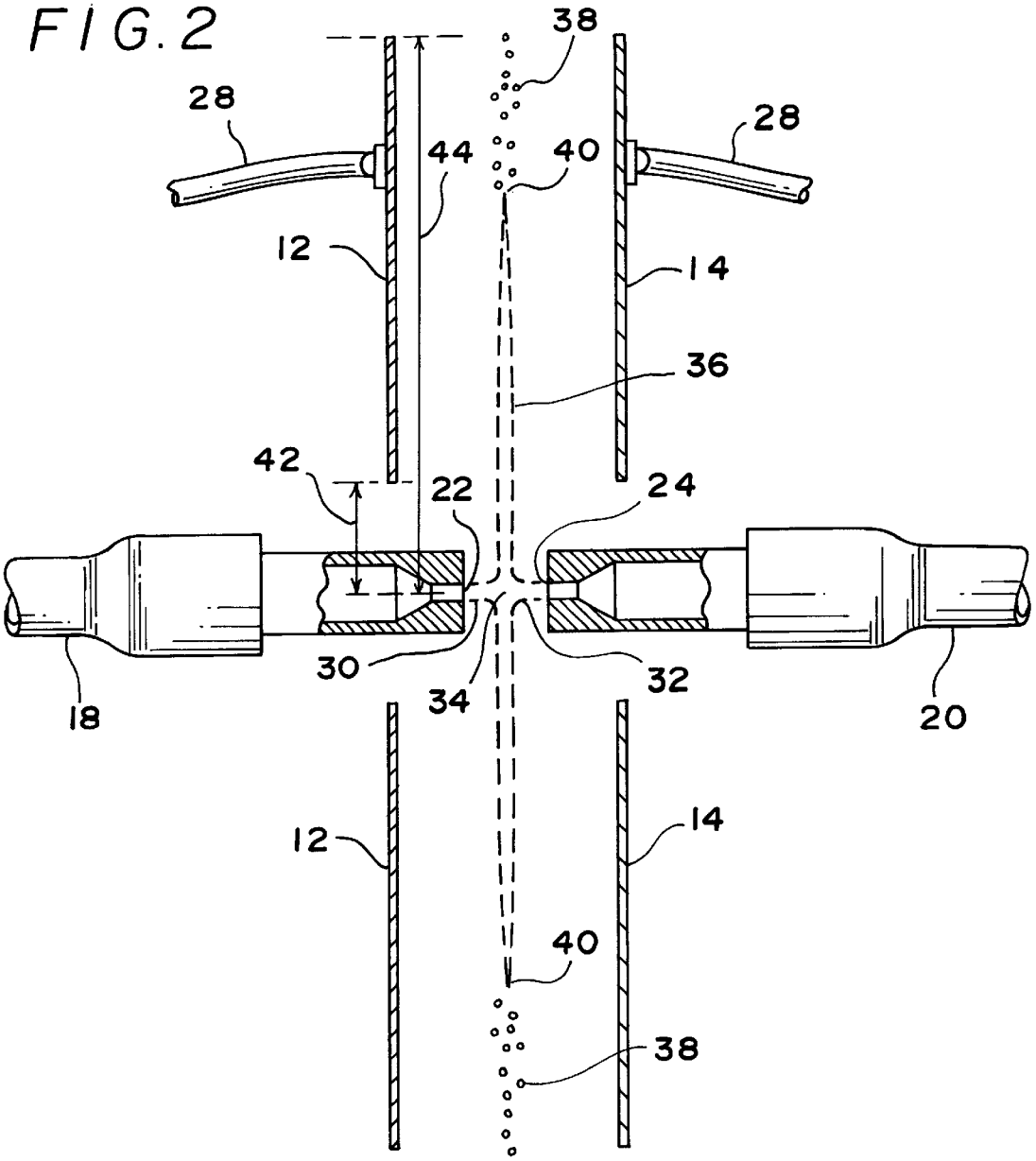
FIG. 2 is a partial side elevational view of the same embodiment, partially in section.
Figure 2:
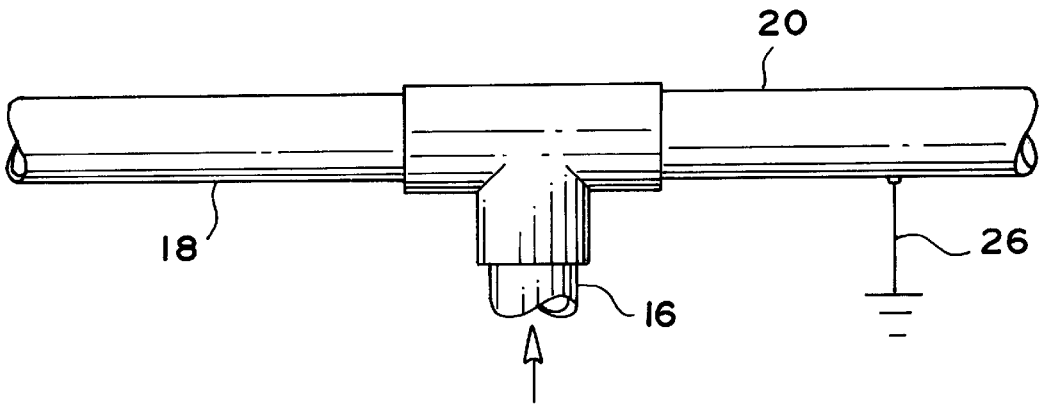

In the preferred embodiment, the inner radius 42 of each of the induction electrodes 12 and 14 is less than the radius of liquid sheet 36, and the outer radius 44 of induction electrodes 12 and 14 is greater than that of liquid sheet 36, so that the point 40 of transition from the continuous liquid sheet 36 to the droplets 38 is between the induction electrodes 12 and 14, as indicated in FIG. 2.

Figure 3:
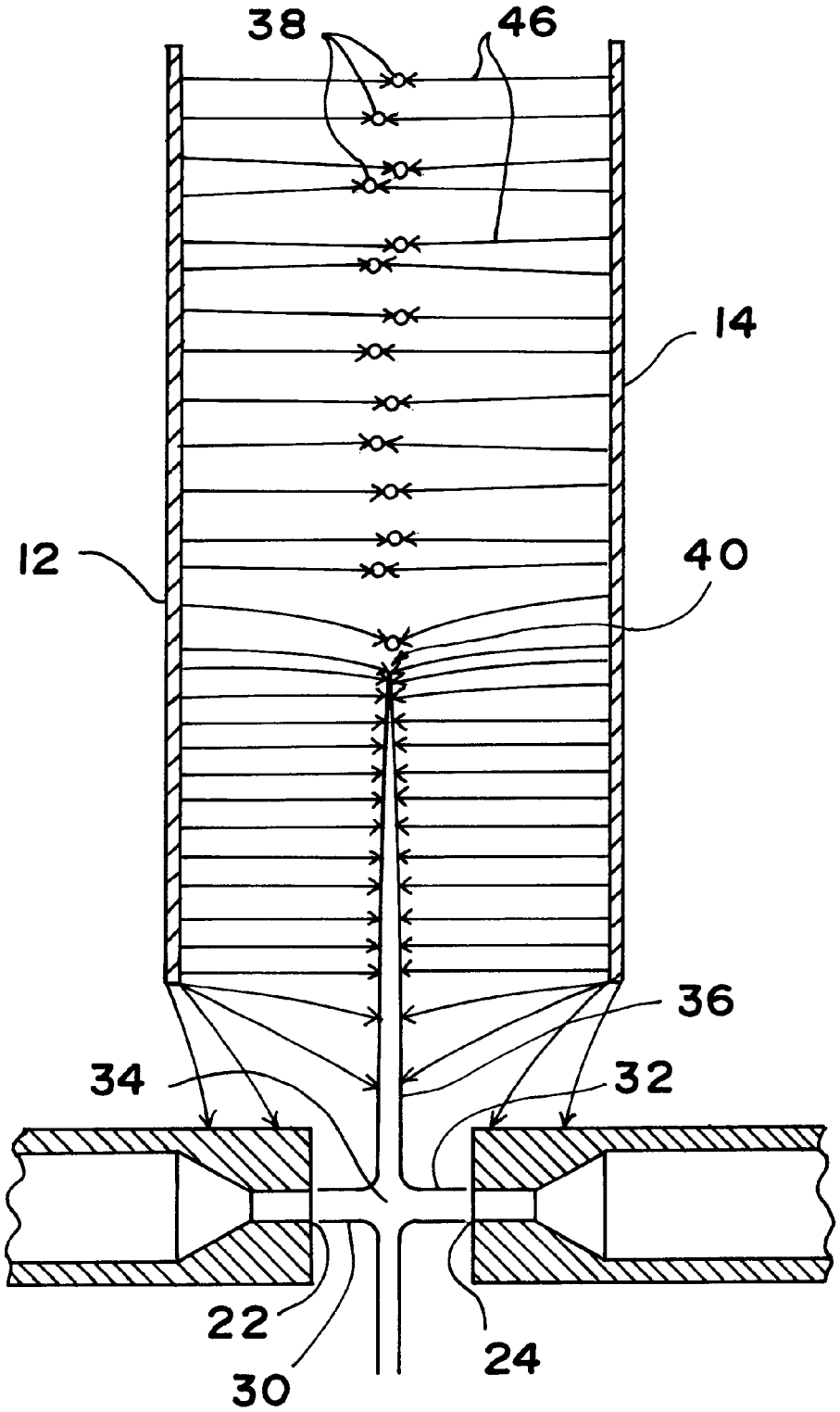
FIG. 3 is a partial sectional view of the same embodiment, illustrating qualitatively the form of the configuration of electric field lines between the induction electrodes and the liquid sheet.

The qualitative nature of the electric field line configuration, for the field lines 46 passing between the induction electrodes 12 and 14 and the liquid, in liquid sheet 36 and the droplets 38, is indicated in FIG. 3. The liquid sheet 36, being formed of liquid which has passed through the grounded nozzle assembly 10, is at ground potential. The equipotential induction electrodes 12 and 14 induce electric charge in the liquid sheet 36, which charge flows into liquid sheet 36 from the ground wire 26, through nozzle assembly 10. The liquid used in the apparatus must be a liquid having adequate electrical conductivity, in order that electric charge may flow through liquid sheet 36 from the grounded nozzle assembly 10, to reach the droplets 38 at the outer edge of liquid sheet 36. Applicant estimates that the minimum required water conductivity would be about 20 micro Siemens/cm. Tap water, which has a conductivity of the order of 100 micro Siemens/cm., has been found adequate in applicant's tests. A pure nonconductive liquid would require some additive, such as a soluble salt.

As indicated in FIG. 3, there will be a higher concentration of field lines 46, and therefore a higher field strength, at point 40, where the liquid makes the transition from liquid sheet 36 to the liquid droplets 38. See, e.g., the approximate solution for a variable capacitor having one plate inserted between two others. Morse and Feshbach, Methods of Theoretical Physics (McGraw Hill 1953) at 1247–1250, and field/potential plot in FIG. 10.21 at p. 1248, and statement at p. 1248 that the electric field ". . . concentrates at the edge [of intermediate plate] D." Thus as each of the droplets 38 is formed, at the edge of liquid sheet 36, the droplet will acquire a large electric charge, which it will carry with it as it moves away from the edge of liquid sheet 36.

Because the plane of liquid sheet 36 is equally distant from induction electrodes 12 and 14, the droplets 38, moving out from the edges of droplets 38, are equally attracted by the two induction electrodes 12 and 14, and thus continue to move out in the same plane in which liquid sheet 36 is located, rather than being drawn to one of the induction electrodes 12 and 14. Applicant's tests of the preferred embodiment indicate that operation is generally not adversely affected by minor perturbations of individual droplet trajectories causing the droplets 38, if deflected out of the plane of liquid sheet 36, to move to one or the other of induction electrodes 12 and 14. However, for high liquid flow rates and high electrode voltage, there is a tendency of the droplets 38 to scatter out of the central plane of liquid sheet 36. This problem is not too great if the outer radius 44 of induction electrodes 12 and 14 is not too large. In fact, some scattering of the droplets 38 is desirable, in producing better mixing of the droplets 38 with the gas to be cleaned. Applicant has observed that for a given geometry and flow rate, the smaller droplets tend to scatter more than the larger ones, as the electrode voltage is increased. For the specific test operating conditions detailed below, in which a flow rate of about 0.5 gal/min. was obtained, scattering of the smaller droplets (approx. 20 micron diameter) was observed at an electrode voltage of about −2 KV. Scattering of the larger droplets (approx. 100 micron diameter) became noticeable at about −5 KV, and became excessive, with a significant number of them impinging upon the induction electrodes 12 and 14, when the voltage was raised to about −8 KV.

Once the charged droplets 38 clear the outer edges of induction electrodes 12 and 14, they are then available for use by other elements of the gas cleaning apparatus, with which the present invention is used, which other elements are not shown in the drawings because they are not part of the present invention.

The operator of the present invention may control the polarity and magnitude of the average electrical charge on each of the droplets 38, by suitable choice of the polarity and magnitude of the voltage applied to the induction electrodes 12 and 14, and the liquid flow rate, determined by the liquid pressure at nozzles 22 and 24, and the orifice diameter of nozzles 22 and 24. The charge per droplet is dependent upon the liquid flow rate, for a given geometry and electrode voltage, because those of the charged droplets 38 which are near the edge point 40 of liquid sheet 36, create a space charge which reduces the electric field strength near point 40, thus reducing the charge induced on subsequent droplets 38. However, since the droplets 38 move outward away from edge point 40 of liquid sheet 36, this space charge effect is a self—limiting one, which cannot reduce the electric field near point 40 to zero.

A sample of the invention, of the preferred embodiment described above, has been found to successfully impart significant charges to liquid droplets generated by the device. In one test, the droplets generated by the device were injected into a region containing a vertical electric field (not the field between the induction electrodes 12 and 14, but a field outside the device), and it was found that the droplets were charged sufficiently, upon suitable choice of the voltage applied to the induction electrodes 12 and 14, that the droplets could be made to move rapidly upward, against gravity, under the influence of the external electric field. In this test, using ordinary tap water as the liquid, with diameters of 0.057" for each of the nozzles 22 and 24, and liquid pressure of about 45 p.s.i., the radius of liquid sheet 36 was about 2–3 inches, and the droplets 38 appeared to have average diameters of about 100 microns, with ambient air between the induction electrodes 12 and 14. Using induction electrodes 12 and 14 with an inner radius 42 of 1", outer radius 44 of 2.5", electrode separation of 1.5", and electrode voltage of 5000 volts, negative, the droplets could be deflected upward by an external electric field of about 100 v/cm.

Although the invention may be used to produce charged droplets of a simple, uniform liquid, the use of the invention is not so limited. For example, in gas cleaning applications it may be useful to employ a liquid emulsion formed by a liquid containing small gas bubbles. The reason is that a droplet of such an emulsion can have a significantly lower density than the same sized droplet of the liquid alone, without the gas bubbles. Thus a charged droplet of the emulsion can exhibit a significantly greater rate of deceleration when moving through the gas to be cleaned, and therefore more quickly reach lower velocity and have a higher likelihood of interaction with an aerosol particle of contaminant to be removed. Therefore it is to be understood in this application, including the claims, that the term "liquid" is to be understood as not being limited to a simple, uniform liquid, but also as including such a liquid emulsion containing gas bubbles.

Figure 4:
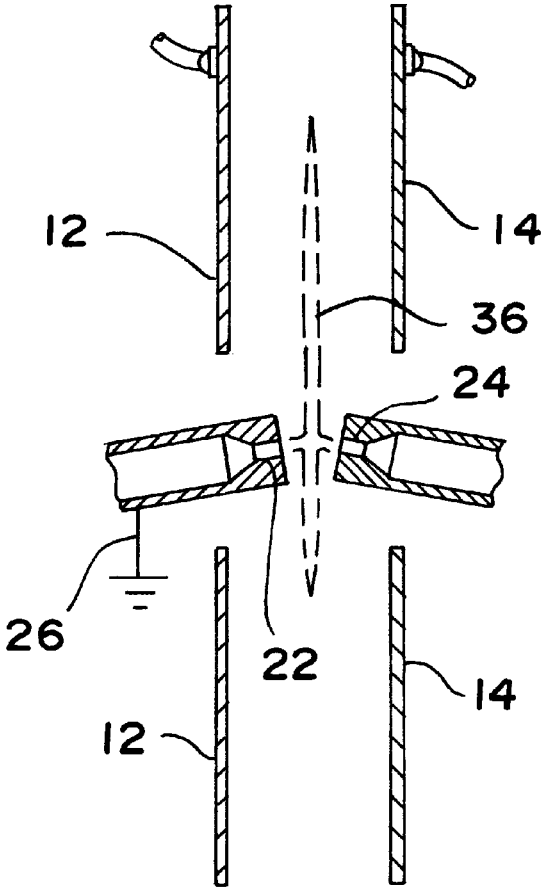
FIG. 4 is a partial sectional view illustrating an alternative embodiment in which the nozzles of the nozzle assembly are oriented at an angle of less than 180 degrees with respect to one another.

The present invention may be used in alternate embodiments, to vary the form of the liquid sheet which generates the droplets 38. As shown in FIG. 4, the nozzles 22 and 24 might be oriented at an orientation less than 180 degrees in opposition, but at some lesser angle, so as to produce a flat elliptically shaped sheet to liquid, to preferentially direct more droplets in a given direction.

Figure 6:
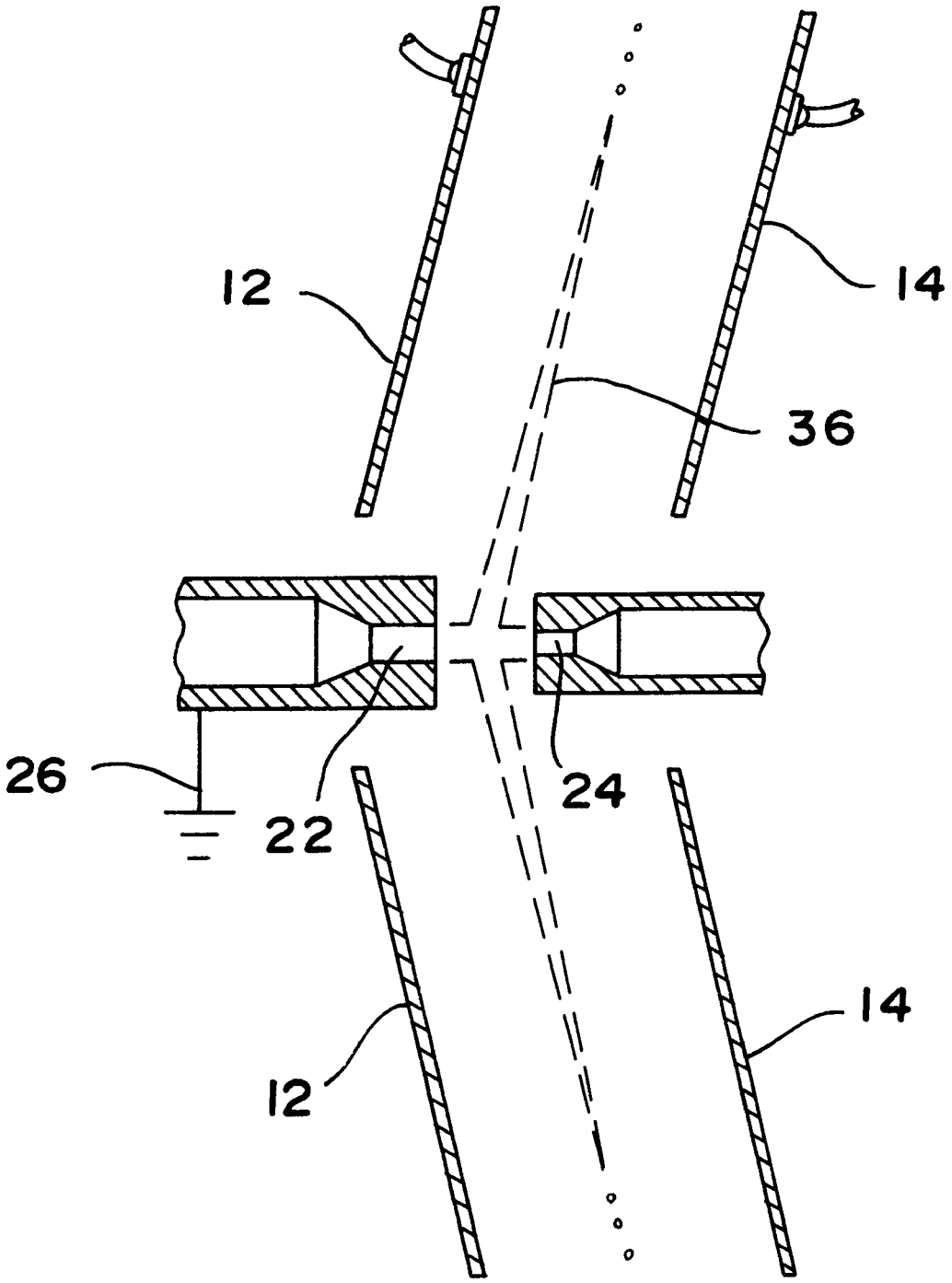
FIG. 6 is a partial sectional view illustrating an alternative embodiment in which the nozzles of the nozzle assembly have unequal diameters, resulting in unequal streams of liquid, producing a conical liquid sheet.

In another alternate embodiment, shown in FIG. 6, the two nozzles 22 and 24 might have different orifice diameters, so as to produce two streams 30 and 32 of different diameters, and thus produce a conically shaped liquid sheet 36. As another alternative embodiment, a conically shaped liquid sheet 36 could instead be produced by simply having two different liquid sources supply liquid to the two nozzles 22 and 24, with different pressures, with identical nozzles 22 and 24. In these embodiments conically shaped induction electrodes 12 and 14 would be used, as indicated in FIG. 6, so that the droplets would not impinge on either electrode.

Figure 5:
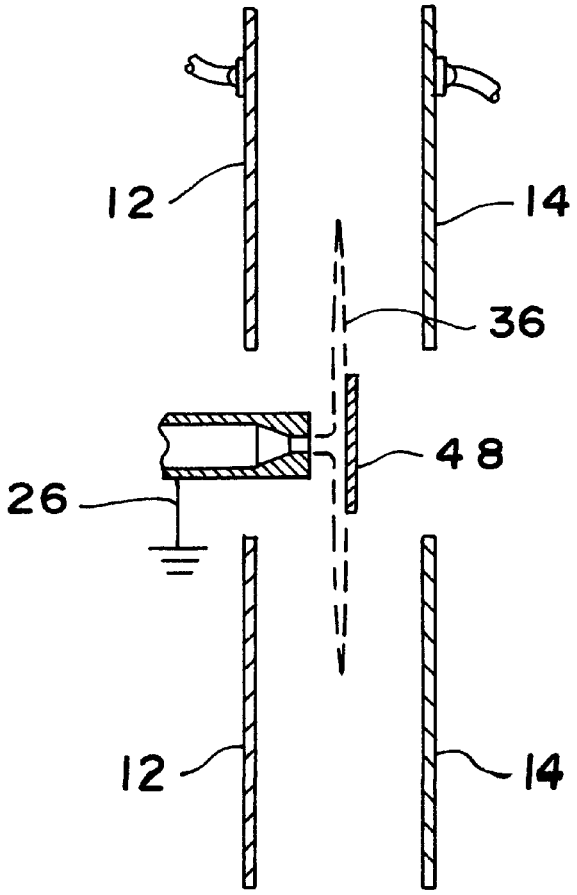
FIG. 5 is a partial sectional view illustrating an alternative embodiment in which the liquid sheet is produced by collision of a single stream of liquid with a fixed target.

In another alternate embodiment, shown in FIG. 5, a single stream 30 from a single nozzle 22 might be used to impinge upon a target 48, to produce a liquid sheet 36 by mechanical shearing of stream 30. Such a target 48 might be of the form of a small flat disk oriented perpendicular to the stream 30. Or target 48 could be a small cone, with axis on the stream 30 and vertex pointing toward nozzle 22, which target would produce a conically shaped liquid sheet 36, and would be used with conically shaped induction electrodes.

In another alternate embodiment, not shown, the inner radius 42 of the induction electrodes 12 and 14, i.e. the radius of the inner edge of the annulus, might be somewhat greater than the outer radius of the liquid sheet 36. But the inner radius 42 must not be made too much larger than the radius of liquid sheet 36, since, in that geometry the space charge effect produced by the charged droplets 38 near point 40 would greatly reduce the field strength near point 40, thus greatly reducing droplet charging, because the electric field lines 46 would all or mostly terminate on the droplets 38, which would thus effectively screen the edge of liquid sheet 36 from being reached by the field lines from induction electrodes 12 and 14.

In another alternate embodiment, not shown, the induction electrodes 12 and 14 have an outer radius somewhat less than the radius of liquid sheet 36.

However this alternate form has the disadvantage, as compared with the preferred embodiment, that a higher voltage would have to be applied to induction electrodes 12 and 14, to produce a given electric field strength at a given point near the outer edge of liquid sheet 36. Such a higher voltage is undesirable, since it increases the likelihood of a dielectric breakdown of the gas, which would reduce the applied electrode voltage significantly at least briefly, thus interfering with droplet charging.

However, the preferred embodiment is that first described, in which the edge of liquid sheet 36 is between the induction electrodes 12 and 14, i.e. the inner and outer radii 42 and 44 of the induction electrodes 12 and 14 are less, and greater, respectively, than the radius of liquid sheet 36. This embodiment should be optimum for maximizing the charge imparted to each of the droplets 38 as it leaves the edge of liquid sheet 36, by maximizing the electric field value at the edge of liquid sheet 36, where the droplets 38 acquire their charges. For the reasons already given above in discussion of other embodiments, it is believed that the preferred embodiment, in which the edge of liquid sheet 36 lies between the induction electrodes 12 and 14, is optimum for minimizing the space charge reduction of electric field strength near the edge of liquid sheet 36, and in minimizing the electrode voltage required to produce a given charging electric field strength at a given point near the edge of liquid sheet 36.

In another alternate embodiment, not shown, the outer edges of the induction electrodes 12 and 14 would not have to be circular, but could be square or rectangular, for example.

Those familiar with the art will appreciate that the invention may be employed in configurations other than the specific forms disclosed above, without departing from the essential substance thereof.

For example, and not by way of limitation, although the flow tubes 18 and 20 and the nozzles 22 and 24 constitute the means for generating the opposing streams of liquid 30 and 32, in the preferred embodiment, other equivalent means could be used instead. For example, each stream might emanate from a small aperture in the side of a reservoir of pressurized liquid.

Similarly, although the flow tubes 18 and 20 are made entirely of conductive metal in the preferred embodiment, as a means of grounding the liquid, it would be possible to use the present invention in a form in which most of each of these tubes was formed of an insulating material, with only a short conductive section to make the electrical connection from the ground wire 26 to the liquid. Or, alternatively, the flow tubes 18 and 20 might be entirely formed of insulating material, with only the nozzles 22 and 24 being formed of conductive material, and the ground wire 26 could simply be connected to each of the nozzles 22 and 24, as shown in FIGS. 4–6.

Those familiar with the art will also appreciate that although the preferred embodiment employs linear colliding streams 30 and 32, to produce the liquid sheet 36, the substance of the present invention is not limited to an apparatus or method involving linear streams of liquid. Instead, one could employ colliding sheets of liquid, each flowing from slit shaped orifice rather than orifices in the form of small circular holes as in the preferred embodiment, to generate the spreading sheet of liquid 36 from which the droplets 38 are emitted. The opposingly oriented nozzles 22 and 24 of the preferred embodiment are simply one convenient means of generating a spreading sheet of liquid for generation of the droplets 38; other equivalent means could be used instead, without departing from the substance of the present invention. For example, one could employ a single spray nozzle so configured as to form a spreading sheet of liquid upon passage of pressurized liquid therethrough; one form of such a nozzle is disclosed in applicant's information disclosure papers, which form has a version which creates a fan shaped spreading sheet of liquid. Fan shaped flat induction electrodes could be used in this case, where the spreading liquid sheet is fan shaped.

Similarly those familiar with the art will understand that although the disk shaped induction electrodes 12 and 14 are used in the preferred embodiment as the means for inducing charges on the droplets 38 leaving the edge of liquid sheet 36, numerous other equivalent electrode configurations could instead be used for performing the charge induction function. In order that the droplets 38 continue to move outward radially in the same plane as the plane of the liquid sheet 36, it is merely necessary that the electric field lines 46 be symmetric about that plane, so that each of the droplets 38 experiences no net electrostatic force in a direction perpendicular to that plane.

And, although the preferred embodiment has the induction electrodes 12 and 14 at high voltage, and has the nozzle assembly 10 and liquid sheet 36 grounded, it would be possible to instead employ a version of the invention in which the nozzle assembly 10 and liquid sheet 36 were at high voltage, and the induction electrodes 12 and 14 were grounded. This version, in which the liquid must be brought to high voltage, is not deemed as practical, however. The liquid source connected to the device would also have to be at high voltage, to avoid electric current flowing through the liquid, owing to its conductivity, between the liquid source and the device, which current could produce a large power loss.

The scope of the invention is defined by the following claims, including also all subject matter encompassed by the doctrine of equivalents as applicable to the claims.

I claim:

1. Apparatus for generating electrically charged droplets of liquid, comprising:

(a) sheet generation means, for generating a spreading sheet of liquid having an edge and emitting droplets of liquid from said edge, wherein said sheet generation means comprises stream generation means, for generating opposing colliding streams of flowing liquid; and (b) charge induction means, in electrostatic field contact with said sheet of liquid, for inducing electrical charges in said droplets of liquid as said droplets of liquid are emitted from said edge of said sheet of liquid.

2. Apparatus of claim 1, wherein said stream generation means comprises:

(a) two spray nozzles, each of said spray nozzles having an axis which is the direction of flow of a stream of pressurized liquid flowing through said nozzle, with said axes of said spray nozzles intersecting in generally opposing directions; and (b) pressurized liquid delivery means, connected to said spray nozzles, for delivering pressurized liquid to each of said spray nozzles.

3. Apparatus of claim 2, wherein said axes are oriented at an angle of at least substantially 180 degrees with respect to one another.

4. Apparatus of claim 1, wherein said charge induction means comprises:

(a) a ground connection means, for connecting said sheet of liquid to ground; and (b) electric field generation means, for generating an electric field in the vicinity of said edge of said sheet of liquid.

5. Apparatus of claim 4, wherein said electric field generation means is a means for generating an electric field which is symmetric with respect to the plane containing said sheet of liquid.

6. Apparatus of claim 5, wherein said sheet generation means is a means for generating a flat disk shaped sheet of liquid, and wherein said electric field generation means comprises two parallel disk shaped annular induction electrodes, having axes coinciding with the axis of said disk shaped sheet of liquid, and means, connected to said induction electrodes, for applying high voltage to said induction electrodes.

7. Method for generating electrically charged droplets of liquid, comprising the steps of:

(a) generating a spreading sheet of liquid having an edge and emitting droplets of liquid from said edge; and (b) inducing electrical charges in said droplets of liquid as said droplets of liquid are emitted from said edge of said sheet of liquid;

wherein said step of generating said spreading sheet of liquid comprises generating opposing colliding streams of flowing liquid.

8. Apparatus of claim 1, wherein said charge induction means comprises:

(a) a means for raising said sheet of liquid to a high voltage;

(b) at least one induction electrode, in electrostatic field contact with said sheet of liquid; and (c) a ground connection means, for connecting each said induction electrode to ground.

9. Apparatus of claim 2, wherein said axes of said spray nozzles are oriented at an angle of less than 180 degrees with respect to one another.

10. Apparatus of claim 5, wherein said electric field generation means comprises:

(a) two identical induction electrodes, each parallel to said sheet of liquid, and at least substantially equally distant from said sheet of liquid, on opposite sides of said sheet of liquid; and (b) means for raising each of said induction electrodes to a high voltage.

11. Apparatus of claim 10, wherein said sheet of liquid and each of said induction electrodes is planar.

12. Apparatus of claim 11, wherein said sheet of liquid is disk shaped, and in which each of said induction electrodes is of the form of an annular portion of a disk, formed by a disk having a circular central portion thereof removed so as to form a circular central aperture, and in which each of said induction electrodes has an electrode axis constituting a line perpendicular to said electrode and passing through the center of said circular central aperture, and in which said induction electrodes are coaxial, with said electrode axes of said induction electrodes coinciding to form a common electrode axis.

13. Apparatus of claim 11, wherein said sheet of liquid is disk shaped, and in which each of said induction electrodes is of the form of a portion of a rectangle, formed by a rectangle having a circular central portion thereof removed to form a circular central aperture, and in which each of said induction electrodes has an electrode axis constituting a line perpendicular to said electrode and passing through the center of said circular central aperture, and in which said induction electrodes are coaxial, with said electrode axes of said induction electrodes coinciding to form a common electrode axis.

14. Apparatus of claim 12, wherein said stream generation means comprises:

(a) two spray nozzles, each of said spray nozzles having an axis which is the direction of flow of a stream of pressurized liquid flowing through said nozzle, with said axes of said spray nozzles at least substantially coinciding with said common electrode axis of said induction electrodes, and with said axes of said spray nozzles intersecting at least substantially at an angle of 180 degrees; and (b) pressurized liquid delivery means, connected to said spray nozzles, for delivering pressurized liquid to each of said spray nozzles.

15. Apparatus of claim 5, wherein said sheet of liquid is cone shaped, lying upon a cone having a liquid sheet cone axis and said cone having a liquid sheet interior cone angle, and in which said electric field generation means comprises:

(a) two identical cone shaped induction electrodes, each of said induction electrodes having an interior cone angle equal to said liquid sheet interior cone angle, and each of said induction electrodes having a cone axis at least substantially coaxial with said liquid sheet cone axis, said induction electrodes being at least substantially equally distant from said sheet of liquid, on opposite sides of said sheet of liquid; and (b) means for raising each of said induction electrodes to a high voltage.

16. Apparatus for generating electrically charged droplets of liquid, comprising:

(a) sheet generation means, for generating a spreading sheet of liquid having an edge and emitting droplets of liquid from said edge; and (b) charge induction means, in electrostatic field contact with said sheet of liquid, for inducing electrical charges in said droplets of liquid as said droplets of liquid are emitted from said edge of said sheet of liquid, wherein said sheet generation means comprises a stream generation means, for generating a single stream of flowing liquid; and a fixed target, placed in said stream of flowing liquid.

17. Apparatus for generating electrically charged droplets of liquid, comprising:

sheet generation means, for generating a spreading sheet of liquid having an edge and emitting droplets of liquid from said edge; and charge induction means, in electrostatic field contact with sheet of liquid, for inducing electrical charges in said droplets of liquid as said droplets of liquid are emitted from said edge of said sheet of liquid, and wherein said sheet generation means comprises (a) a single spray nozzle, containing within said nozzle a means for generating a spreading sheet of liquid upon flow of liquid through said spray nozzle; and (b) pressurized liquid delivery means, connected to said spray nozzle, for delivering pressurized liquid to said spray nozzle.

18. Apparatus of claim 2, wherein said pressurized liquid delivery means is a means of delivering pressurized liquid at equal pressures to said spray nozzles.

19. Apparatus of claim 2, wherein said pressurized liquid delivery means is a means of delivering pressurized liquid at different pressures to said spray nozzles.

20. Apparatus of claim 2, wherein said spray nozzles have apertures of equal diameters.

21. Apparatus of claim 2, wherein said spray nozzles have apertures of different diameters.

* * * * *